US012396504B2

(12) United States Patent
Blythe

(10) Patent No.: US 12,396,504 B2
(45) Date of Patent: Aug. 26, 2025

(54) STORAGE COMPARTMENT OR POCKET FOR ELECTRONIC DEVICES

(71) Applicant: DRYMAX TECHNOLOGIES, INC., Paso Robles, CA (US)

(72) Inventor: William A. Blythe, Atascadero, CA (US)

(73) Assignee: DRYMAX TECHNOLOGIES, INC., Paso Robles, CA (US)

( * ) Notice: Subject to any disclaimer, the term of this patent is extended or adjusted under 35 U.S.C. 154(b) by 725 days.

(21) Appl. No.: 16/205,962

(22) Filed: Nov. 30, 2018

(65) Prior Publication Data

US 2019/0159537 A1 May 30, 2019

Related U.S. Application Data

(60) Provisional application No. 62/592,894, filed on Nov. 30, 2017.

(51) Int. Cl.
*A41D 27/20* (2006.01)

(52) U.S. Cl.
CPC ..... *A41D 27/205* (2013.01); *A41D 27/204* (2013.01); *A41D 27/208* (2013.01)

(58) Field of Classification Search
CPC .. A41D 27/205; A41D 27/208; A41D 27/204; A41D 27/20
USPC ..... 2/247
See application file for complete search history.

(56) References Cited

U.S. PATENT DOCUMENTS 5,165,115 A * 11/1992 Stanislaw ..... A41D 27/201 2/403
5,551,496 A * 9/1996 Gray, Jr. ..... A45C 1/04 150/134
5,738,937 A * 4/1998 Baychar ..... A43B 5/0405 428/316.6
2002/0134809 A1* 9/2002 Angus ..... A45F 3/00 224/662
2008/0131648 A1* 6/2008 Baychar ..... A43B 19/00 428/90
2009/0082835 A1* 3/2009 Jaax ..... H02J 7/007192 607/61
2012/0096628 A1* 4/2012 Grady ..... A41D 27/204 2/249
2012/0246795 A1* 10/2012 Scheffler ..... A41D 13/0007 2/69
2014/0361062 A1* 12/2014 Newton ..... A45F 5/02 224/674
2015/0089708 A1* 4/2015 Trevino ..... F41C 33/048 2/69

(Continued)

FOREIGN PATENT DOCUMENTS

CN 202456566 U 10/2012

OTHER PUBLICATIONS

"Faytex—The Original just keeps getting better", 2013, http://www.faytex.com/technology.html, p. 2 (Year: 2013).*

*Primary Examiner* — Nathan J Newhouse
(74) *Attorney, Agent, or Firm* — Christopher J. Knors; Moore & Van Allen PLLC

(57) ABSTRACT

Storage compartment or pocket having hydrophobic layers or removable hydrophobic material suitable for attachment to or placement between a garment for retaining and/or securing an electronic device and protecting or preventing the electronic device from contacting moisture and/or fluids.

5 Claims, 10 Drawing Sheets

(56) References Cited

U.S. PATENT DOCUMENTS

| | | | | |
|---|---|---|---|---|
| 2016/0165981 | A1 | 6/2016 | Dorn | |
| 2016/0286866 | A1* | 10/2016 | Carlson | A41B 1/08 |
| 2018/0049489 | A1* | 2/2018 | Noll | A41D 3/00 |
| 2018/0084852 | A1* | 3/2018 | Page | A41D 19/002 |
| 2018/0135939 | A1* | 5/2018 | Tedder | F41C 33/0209 |

* cited by examiner

STORAGE COMPARTMENT OR POCKET FOR ELECTRONIC DEVICES

TECHNICAL FIELD

The present disclosure relates to the field of garments and the field of electronic devices and storage means within the garment for retaining and protecting or preventing the electronic device from contacting moisture and/or fluids.

BACKGROUND

Smart phones, portable media players and other electronic devices are preferably retained in a storage compartment or pocket associated with a garment. Conventional garments with such storage means are both cumbersome and uncomfortable and it also makes it difficult to read the electronic device while engaged in an activity such as walking or running without risk of exposing the electronic device to condensation and/or bodily fluids. Providing storage means having complete waterproof protection eliminates the ability to allow the area around the electronic device that is otherwise in contact with the wearer to breathe and/or dry effectively resulting in discomfort and possible condensation within the storage means.

In most garments, such as shorts, a waterproof liner (plastic fabric) is employed to keep the sweat off the electronic device and the electronic device is subject to exposure to an contact with perspiration. In addition, the waterproof liner, if it is either against the skin or even if it has a fabric layer between the skin and the waterproof pocket liner, causes the skin of the wearer in that area to get warmer and/or be discomforting. When the electronic device is in the pocket, the heat of the electronic device can also make the wearer even more warmer in that general vicinity. So it is a disadvantage for a wearer of a garment comprising such a pocket.

SUMMARY

A principal object of this disclosure is to provide a storage compartment or pocket that will provide moisture vapor transmission, evaporative cooling, and protection of the electronic device from moisture and/or fluids to occur. This will provide more comfort with reduced heat stress, and potentially make longer cycles of wearing the garment with the electronic device possible.

It is a further object to provide a breathable storage compartment or pocket for a garment that can be repeatedly used, e.g., washing and drying capability.

In one embodiment, the present storage compartment or pocket that is a breathable laminate that comprises a hydrophobic spacer material adjacent to a stretchable hydrophobic material. The storage compartment or pocket laminate construction is suitable for attachment to a garment, such as shorts or a shirt. In one example, the storage compartment or pocket can be used in combination with an outer shell material comprising a wicking or non-wicking woven or nonwoven fabric.

In other embodiments, the present disclosure is a breathable, semi-permeable, laminate that comprises hydrophobic spacer material layer having top and bottom surfaces; and at least one hydrophobic stretchable fabric layer attached to at least a portion of the perimeter of the hydrophobic spacer material layer so as to provide a storage compartment or pocket suitable for receiving an electronic device. Variations of this embodiment further include an outer shell textile layer.

In other embodiments, a storage compartment or pocket for fastening to a garment is provided, the storage compartment or the pocket comprising: a garment fabric having a skin facing side and an opposed side; a hydrophobic spacer material adjacent the opposed side; and a stretchable hydrophobic material adjacent the hydrophobic spacer material forming a storage compartment or a pocket. In one example, the hydrophobic spacer material is secured, at least in part, to the opposed side. In another example, the hydrophobic spacer material is removable from the storage compartment or the pocket. In yet another example, alone or in combination with any of the previous examples, the storage compartment or the pocket further comprises an outer shell material comprising a wicking or non-wicking woven or nonwoven fabric.

Aspects of the present disclosure include the articles described herein being storage compartment or pocket for a garment. Examples of such garments include shorts, bathing suits, athletic apparel, jerseys, etc. In one aspect, the storage compartment or pocket is configured for garments that are designed for a tight-fit or form-fit about the arm or leg of the wearer. In another aspect, the storage compartment or pocket is configured for garments that are designed for a tight-fit or form-fit about the arm or leg of the wearer so as to provide a self-sealing opening for the electronic device. In one aspect, the storage compartment or pocket is configured for garments that are designed for a tight-fit or form-fit about the arm or leg of the wearer and allow the use of wires or cable connectors to the electronic device.

Other objects will be apparent to one of ordinary skill in the art when reviewing the instant specification, drawings, and claims.

BRIEF DESCRIPTION OF THE DRAWING

In order that the disclosure be more readily understood, some embodiments thereof are described in the figures, summarized here, by way of example only.

DETAIL DESCRIPTION

Figure 1:
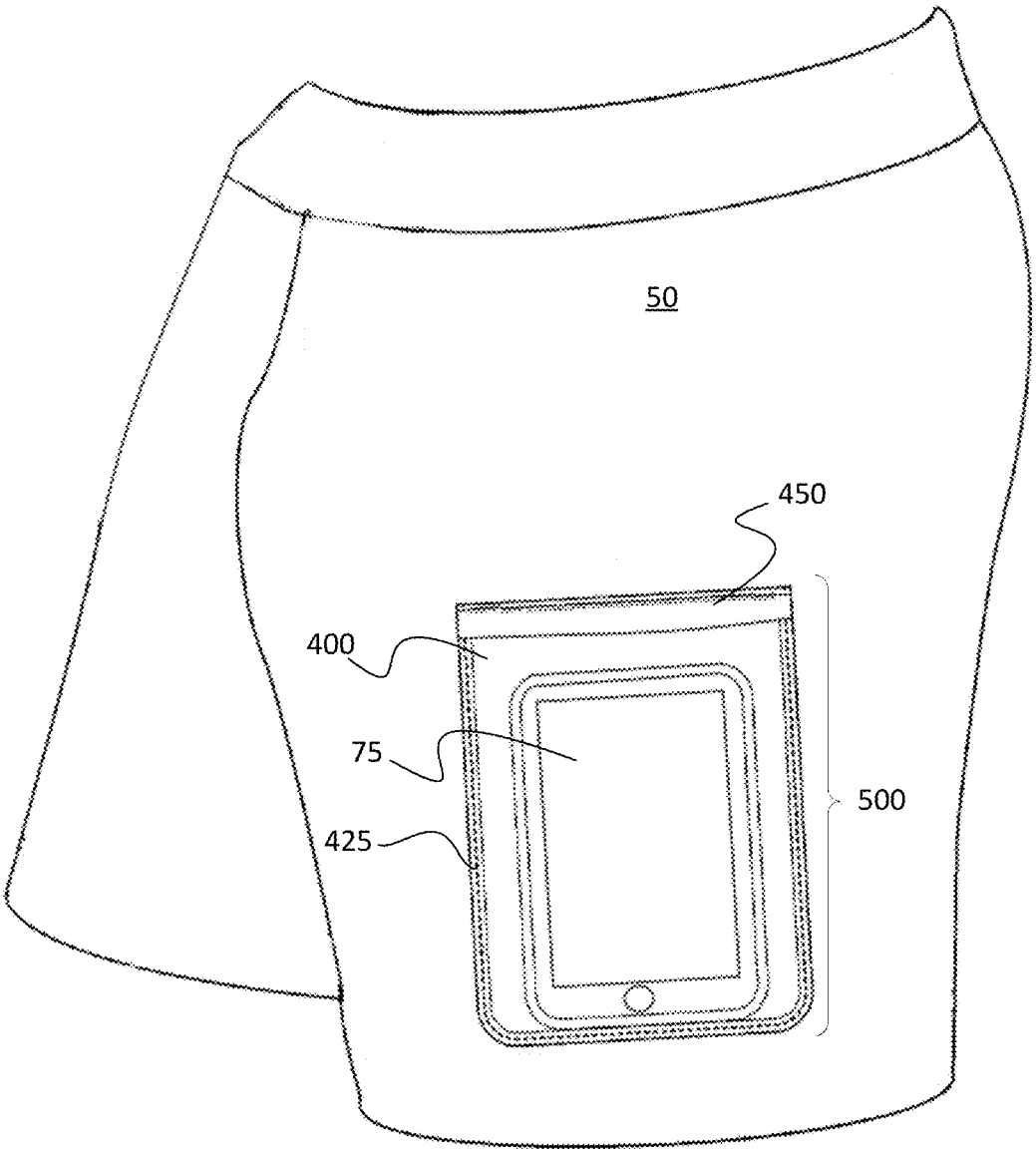
FIG. 1 is a side perspective view of the storage compartment or pocket in accordance with the present disclosure.

As stated above, an object of the present disclosure is to provide a storage compartment or pocket that provides liquid protection for electronic devices as well as moisture vapor transmission and/or evaporative cooling to occur so as to provide improved comfort for the wearer.

By using a hydrophobic spacer material as a laminate component, the storage compartment or pocket is configured so as to not uptake, absorb, draw, or contain perspiration and is provided advantageous separation of the electronic device from the skin of the wearer, allowing for air circulation. Such a configuration provides the wearer with improved comfort in allows the wearer to be cooler, as well as protects the electronic device from excess heat during normal or physical activity. In one aspect, the use of hydrophilic fabrics and/or materials is avoided in the construction of the storage device or pocket of the present disclosure.

As used herein, these terms are defined as follows:

"Laminate" as used herein is meant to exemplify a flexible article comprised of two or more flexible layers, resulting in a composite. Examples of laminates of the present disclosure can be comprised of a hydrophobic and/or non-wicking spacer material and "Seam" as used herein is meant to defined an area where two or more pieces or panels of the laminate are joined together by sewing, gluing, heat sealing, other mechanical joining procedures, and combinations thereof.

"Breathable" as used herein is defined as the ability to transport moisture vapor (such as perspiration, for example) through a material. Breathable typically refers to materials having a Moisture Vapor Transmission Rate as measured by ASTM E96 and expressed in terms of $g/m^2/24$ hr.

"Breathability" as used herein refers to a property of a laminate or layer of the laminate that is measured in terms of moisture vapor transmission rate (MVTR), where higher values represent a more breathable material/laminate and lower values representing a less breathable material/laminate. MVTR generally refers to the rate at which water vapor permeates through a material as measured in units of grams per meter squared per 24 hours ($g/m^2/24$ hr). Quantatively, breathability is defined herein MVTR rates of over 100 and up to about 7000 $g/m^2/24$ hr.

"Nonwoven web" or "nonwoven" refers to a web having a structure of individual threads (e.g., fibers or filaments) that are randomly interlaid, not in an identifiable manner as in a knitted storage compartment or pocket. Nonwoven webs include, for example, meltblown webs, spunbond webs, carded webs, wet-laid webs, airlaid webs, coform webs, hydraulically entangled webs, etc.

"Semi-permeable" or "semi-permeability", as used herein, means that the layer/laminate would significantly inhibit the flow of liquid or vapor from one side of the layer to the other side of the layer/laminate. Semi-permeable does not mean that the layer/laminate is impermeable to all vapors; for example, it may be permeable to water vapor but not organic solvents.

Hydrophobic and/or Non-Wicking Spacer Material

In one example, suitable materials for the hydrophobic spacer material are multi-zone lining systems such as DRI-LEX® which can be used alone or in combination with other materials such as GORE-TEX®. Non-limiting examples of suitable hydrophobic spacer materials are AEROSPACER® (Faytex Corp., Weymouth, Mass.), and PERSPAIR (Lenzi Egisto S.p.A, Vaiano, IT). Other multi-zone lining systems may be used or just the inner hydrophobic fiber part of such multi-zone lining systems may be used alone without fabric on opposing sides thereof. In one example, the hydrophobic spacer material is essentially non-wicking as to water. In another example, the hydrophobic spacer material is completely non-wicking as to water.

By way of example DRI-LEX® provides excellent moisture movement properties as well as outstanding abrasion resistance, hand-feel, and attractive patterns and textures. While not being held to any particular theory, the present disclosure provides a storage compartment or pocket whereby perspiration is moved away from the skin surface by heat and mass transfer and into the hydrophobic spacer material of the storage compartment or pocket. The hydrophobic spacer material then works in conjunction with the hydrophobic stretch mesh fabric to re-distribute moisture. In one example, the hydrophobic spacer material comprises DRI-LEX® Diffusion fabric.

Hydrophobic Stretch Mesh Fabric

In one example, the hydrophobic stretch mesh fabric is a two-way stretch fabric. In another example, the hydrophobic stretch mesh fabric is a four-way stretch fabric. Suitable examples of hydrophobic stretch mesh fabrics include but are not limited to SPANDEX, ELASTANE (LYCRA) and includes polyester-spandex blends, stretch satin, stretch velvet, nylon-spandex, Rayon knit-spandex, rubber-latex, and neoprene rubber. In one example, the hydrophobic stretch mesh fabric is comprised of essentially all hydrophobic fiber. In another example, the hydrophobic stretch mesh fabric is comprised completely of hydrophobic fiber. Suitable fabrics may be knitted, such as Jersey knit, or other knit patterns that provide for 2-way or 4-way stretching or elastomeric recovery.

The thickness of this layer can vary, and includes thicknesses ranging from about 0.5 to about 2.5 mils.

This layer of the laminate can be breathable and liquid impermeable. In one example, the hydrophobic stretch mesh fabric is a microporous and blocks the denser liquid molecules while allowing water vapor molecules to move through a series of microscopic voids in the fabric structure.

Microporous fabrics include polyolefins. Representative olefinic polymers (polyolefins) include high and low basis weight polyethylene, polypropylene, polyvinyl containing polymers, butadiene containing polymers and the like. Condensation polymers include polyesters such as polyethylene terephthalate and polybutylene terephthalate, polyamides such as nylon 6, nylon 13 and nylon 66, polycarbonates and polysulfones. Polyphenylene oxide is representative of the oxidation polymers which can be used. Blends of thermoplastic polymers may also be used in connection with this embodiment and others. While most of these thermoplastic polymers can be utilized in forming a suitable web for combining with microporous film, the microporous film can be comprised of polymeric materials, i.e. thermoplastics, which can survive sewing, adhesive bonding, ultrasonic point bonding and the like without losing the properties and maintaining moisture vapor permeability.

Optional Outer Shell

A woven or nonwoven outer shell (or outer shell textile layer) may be fastened to the portion of the garment adjacent the storage compartment or pocket. The outer shell textile layer may be woven, knit, or nonwoven. A nonwoven textile layer may be chosen if the product is to be considered limited use or disposable, whereas a woven fabric may be chosen if of the product is to be considered reusable. As used herein, the term "nonwoven" means a web having a structure of individual fibers or threads which are interlaid, but not in an identifiable manner as in a knitted storage compartment or pocket. Nonwoven storage compartment or pockets or webs have been formed from various processes such as, for example, meltblowing processes, spunbonding processes, and bonded carded web processes.

As one of ordinary skill in the art would appreciate, there are many on the market nonwoven products, such as polyester or polypropylene blends that may be used in conjunction with this layer. That is, as indicated above, the outer shell textile layer may be any desired textile, including woven, knitted and nonwoven materials and composites of such materials. The textile may be selected based on the properties required for a given application, exercising, particular sports, comfort, weight, and moisture vapor transmissivity. Suitable textiles include NOMEX, available from Southern Mills, N.Y. or nylon. Other suitable textiles include nonwovens such as SPANDEX, or VILENE nonwoven, commercially available from Freudenberg, and E89 nonwoven, commercially available from DuPont. The textile layer generally may have many variations in terms of thickness.

The outer shell textile layer generally does not contribute significantly to the receiving, securing, and protecting of the electronic device offered by the storage compartment or pocket laminate, nor does it significantly negatively affect the receiving, securing, and protecting of the electronic device provided by the laminate. The outer shell textile layer can offer additional physical protection against abrasion tear and puncture of the storage compartment or pocket.

Fastening

A variety of techniques, methods, and processes may be used to passion the layers of the storage compartment or pocket laminate one to the other. In one example, conventional stitching techniques are used alone or in combination with other bonding, fusing, or melting techniques.

In certain embodiments of the present disclosure, an adhesive may be used to fasten the layers of the storage compartment or pocket laminate. The adhesive and/or adhesive process may be forming a continuous adhesive layer or maybe discontinuous such as a spaced apart pattern applied using the gravure process or applied as random filaments of adhesive.

Alternatively, the layers may be thermally fused or pressure laminated, without any intervening adhesive. The process parameters for this operation will vary depending on the materials used for the components of the laminate and the garment fabric used, and would be selected to provide good adhesion without significant damage or deterioration of any of the layers or the garment.

Yet another significant variation of the present disclosure would be a breathable storage compartment or pocket that would also be readily machine washable.

Articles comprising the storage compartment or may be configured into a variety of configurations that take advantage of the unique properties of the present disclosure. Traditional fastening techniques apparent to those of skill in the art may be used to assemble laminate panels into desired configurations.

With reference to FIG. 1 a perspective view of an exemplary storage compartment or pocket 500 is shown attached to an exemplary garment 50. Pocket 500 is configured so as to receive and accommodate electronic device 75. As shown, pocket 500 has finished top 450 of hydrophobic stretch fabric 400 that is shown as stitched to garment 50 with stitching 425 about the sides and bottom of pocket 500. In one example, finished top 450 is constructed of a turned back hem with cover stitch that provides four-way stretch to the finished top for facilitating receiving and removing electronic device 75.

Figure 2:
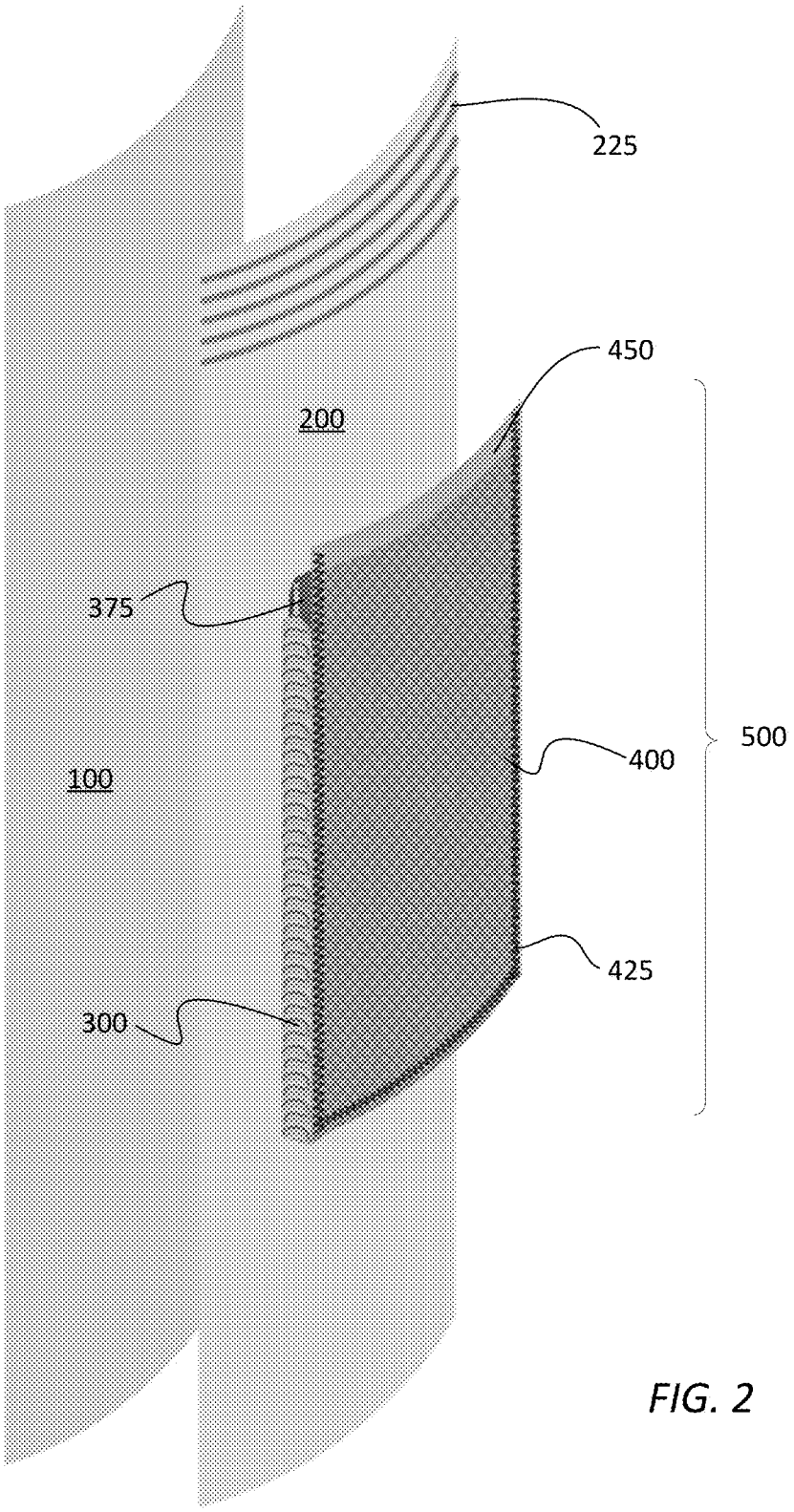
FIG. 2 is an exploded side view of the storage compartment or pocket in accordance with the present disclosure.

With reference to FIG. 2 an exploded side view of the storage compartment or pocket 500 in accordance with the present disclosure is shown comprising hydrophobic spacer material 300 in closest proximity to skin surface 100 attached to hydrophobic stretch mesh fabric 400 and furthest proximity from skin surface 100. As shown, attachment is by stitching 425. Hydrophobic spacer material 300 as finished top 375 which may be sown or bonded or otherwise attached to provide for receipt of electronic device. Hydrophobic stretch mesh fabric 400 also has finished top 450 which may be stitched or bonded so as to prevent mesh fabric from unraveling. Stitches 425 provide means for attaching storage compartment or pocket 500 to portion of garment fabric 200. As shown, stitches 425 are absent adjacent to finished top 375 of spacer material and finished top 450 sown to hydrophobic stretch mesh fabric 400 as to provide an opening for receiving electronic device 75. By virtue of the fact that hydrophobic stretch mesh fabric 400 is configured to stretch in at least 2 directions, or in at least 4 directions, fabric 400 will provide securement of electronic device 75 in combination with hydrophobic spacer material 300. Hydrophobic spacer material 300 in one aspect has elasticity less than that of stretch mesh fabric 400. Hydrophobic spacer material 300 in one aspect as resiliency of at least 2× that of wool, at least 5× that of wool, or at least 10× that of wool. The resiliency of hydrophobic spacer material 300 in combination with hydrophobic stretch mesh fabric 400 provides for containment of the electronic device during wearing of the garment by a user.

The thickness of hydrophobic spacer material 300 can be about 0.5 to about 2.5 mils. The thickness of the hydrophobic stretch mesh fabric 400 can be about 0.5 to about 2.5 mils.

Figure 3:
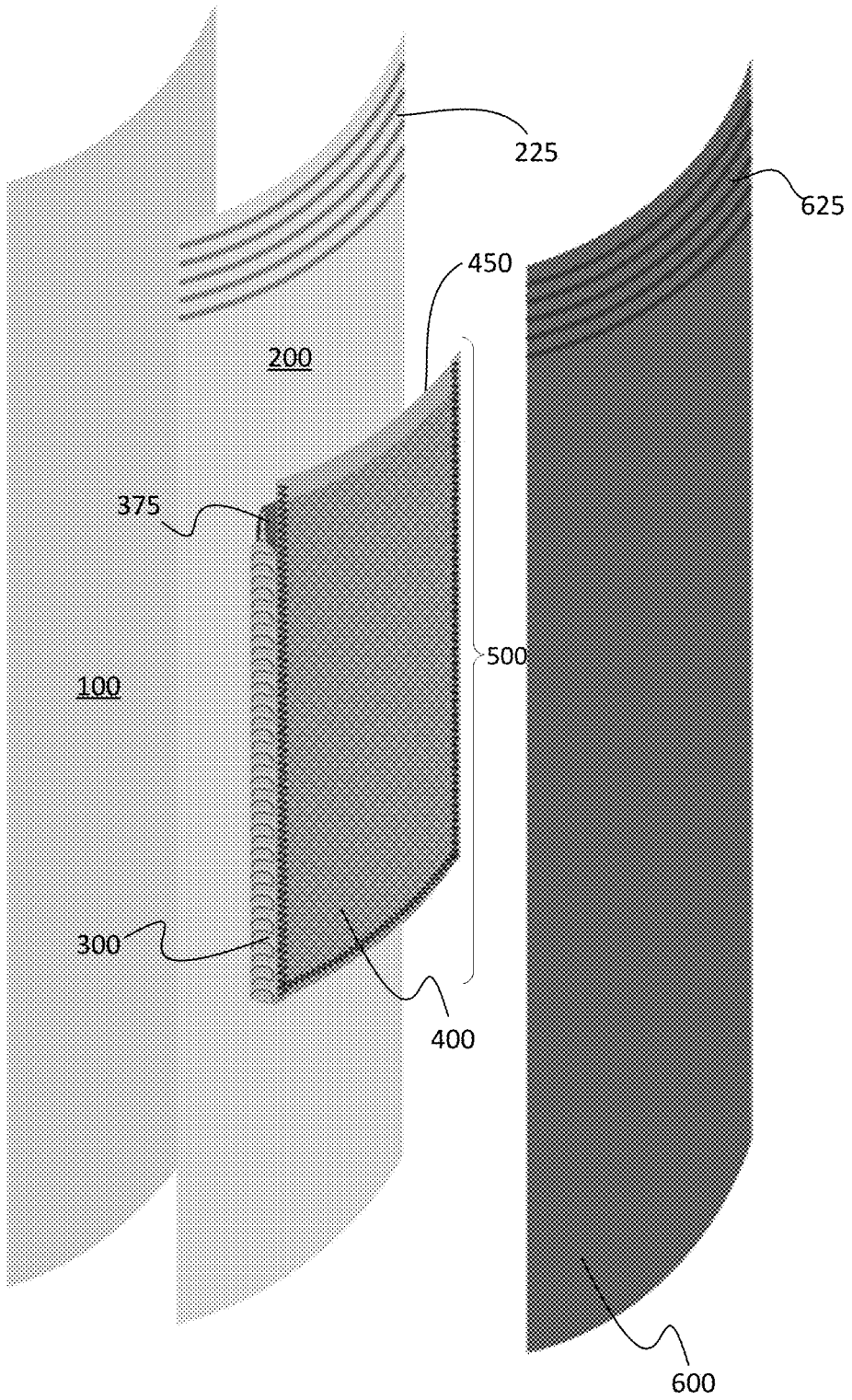
FIG. 3 is an exploded side view of the storage compartment or pocket with optional outer shell fabric in accordance with the present disclosure

With reference to FIG. 3, an exploded side view of the storage compartment or pocket 500 is shown with optional outer shell fabric 600 where outer shell fabric 600 may contain elastomeric banding 625 corresponding to elastomeric banding 225 of the portion of garment fabric 200. In one aspect elastomeric banding 625 and elastomeric banding 225 are fastened to garment fabric 200.

Figure 4:
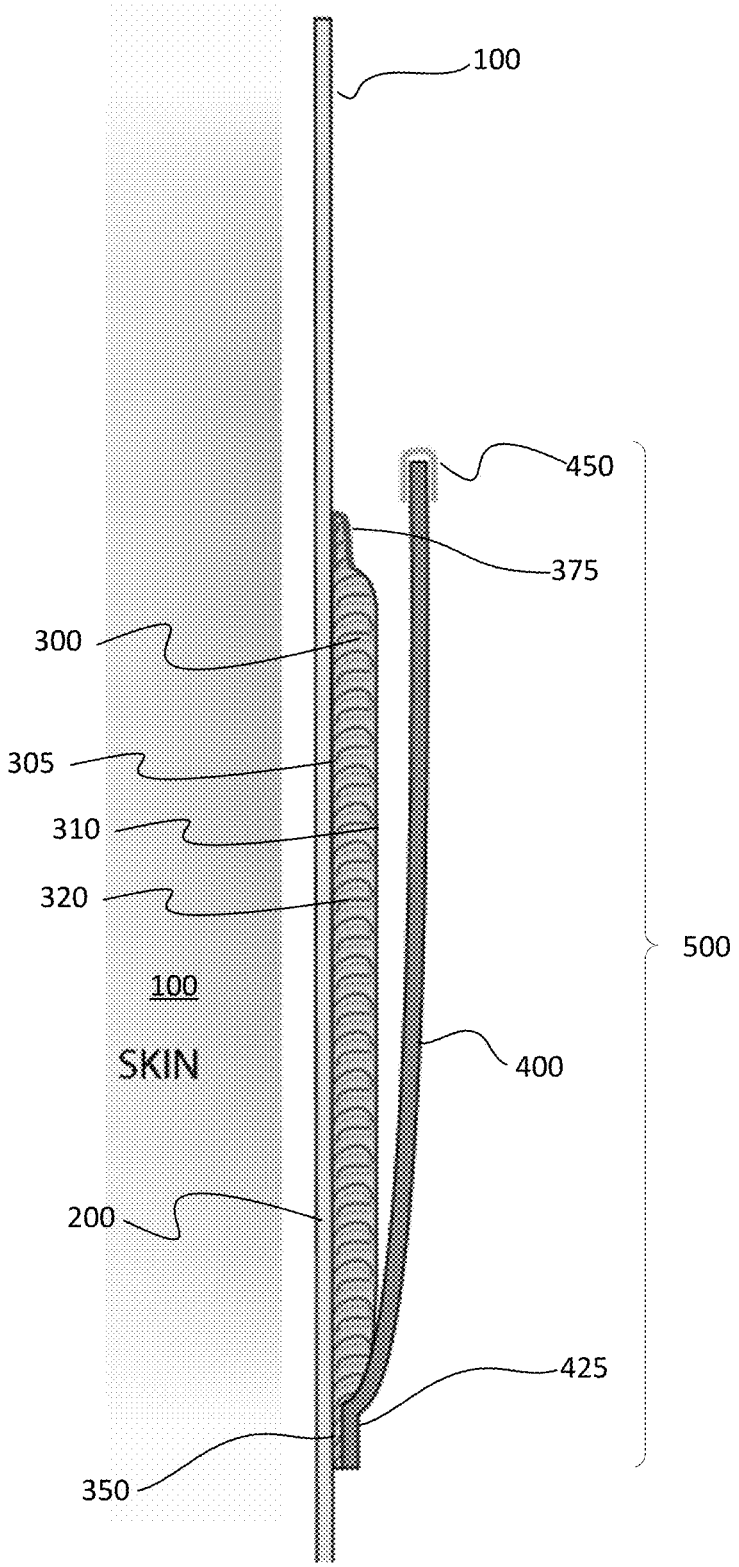
FIG. 4 is a sectional side view of the storage compartment or pocket attached to the garment in accordance with the present disclosure.

With reference to FIG. 4, a sectional side view of the storage compartment or pocket 500 attached to the portion of garment 200 is shown where hydrophobic spacer material as skin-facing surface 305 and opposing surface 310 with hydrophobic fiber filaments 320 contain their between. Hydrophobic spacer material surfaces 305, 310 may be of a microporous material and/or contain a honeycomb or other open pattern type design to permit airflow. Formation of the storage compartment or pocket is illustrated by the bonding of bottom edge 350 of hydrophobic spacer material with corresponding bottom edge 425 of stretch mesh fabric 400.

Figure 5:
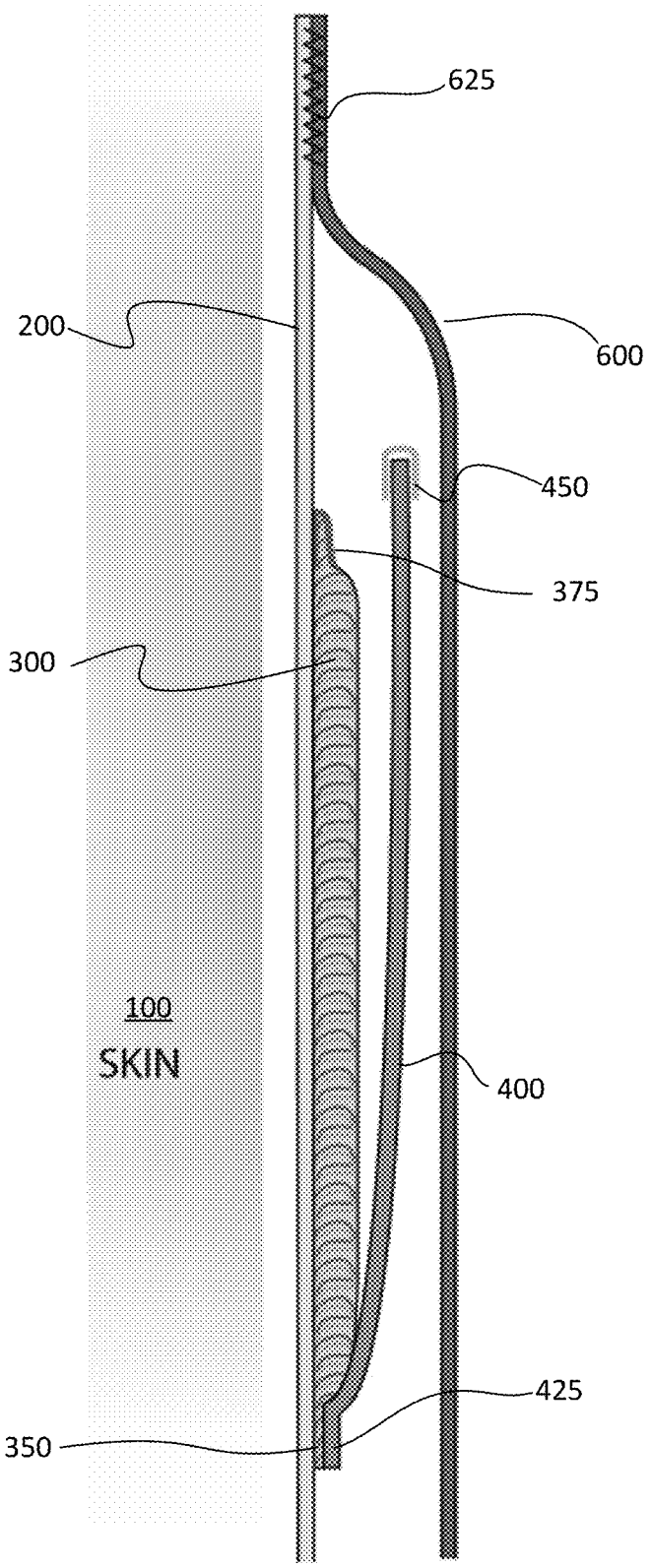
FIG. 5 is a sectional side view of the storage compartment or pocket with optional outer shell fabric in accordance with the present disclosure.

With reference to FIG. 5, a sectional side view of the storage compartment or pocket 500 with optional outer shell fabric 600 is shown with edge 625 bonded to portion of garment 200 in accordance with the present disclosure.

Figure 6:
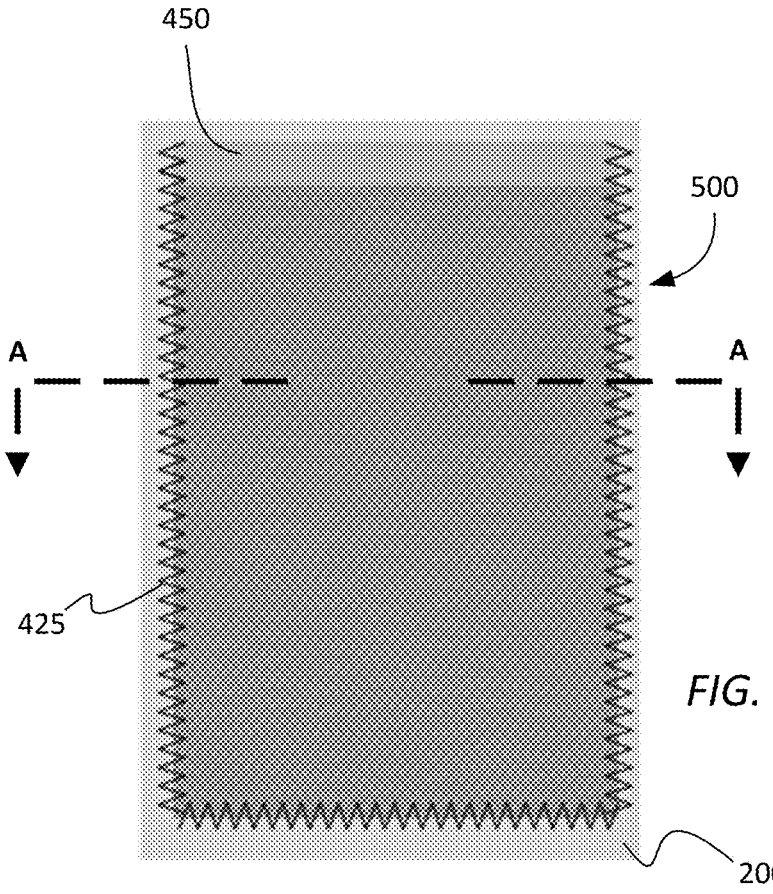
FIG. 6 is a front view of the storage compartment or pocket in accordance with the present disclosure with sectional line A-A.

With reference to FIG. 6 n front view of the storage compartment or pocket 500 is shown attached to portion of garment fabric 200 exemplified by stitching 425.

Figure 7:
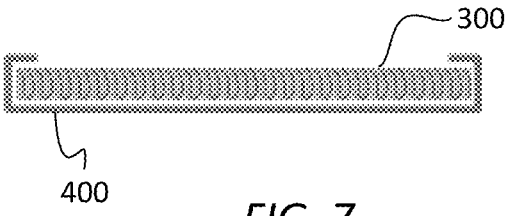
FIG. 7 is a sectional top view of the storage compartment or pocket along sectional line A-A in accordance with the present disclosure.
Figure 8:
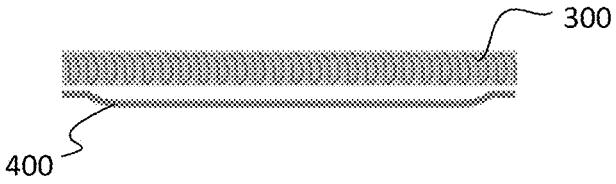
FIG. 8 is a sectional top view of an alternate configuration of the storage compartment or pocket along sectional line A-A in accordance with the present disclosure.

FIG. 7 and FIG. 8 depict sectional top views of the storage compartment or pocket 500 along sectional line A-A showing alternate attachment configurations of the hydrophobic spacer material 300 and hydrophobic stretch mesh fabric 400. In the configuration shown in FIG. 7, hydrophobic stretch mesh fabric 400 wraps around at least one edge of hydrophobic spacer material 300 when fastened to portion of garment 200. In the configuration shown in FIG. 8, edges of hydrophobic stretch mesh fabric 400 align with edges of hydrophobic spacer material 300 when fastened to portion of garment 200.

Figures 9A, 9B, 9C:
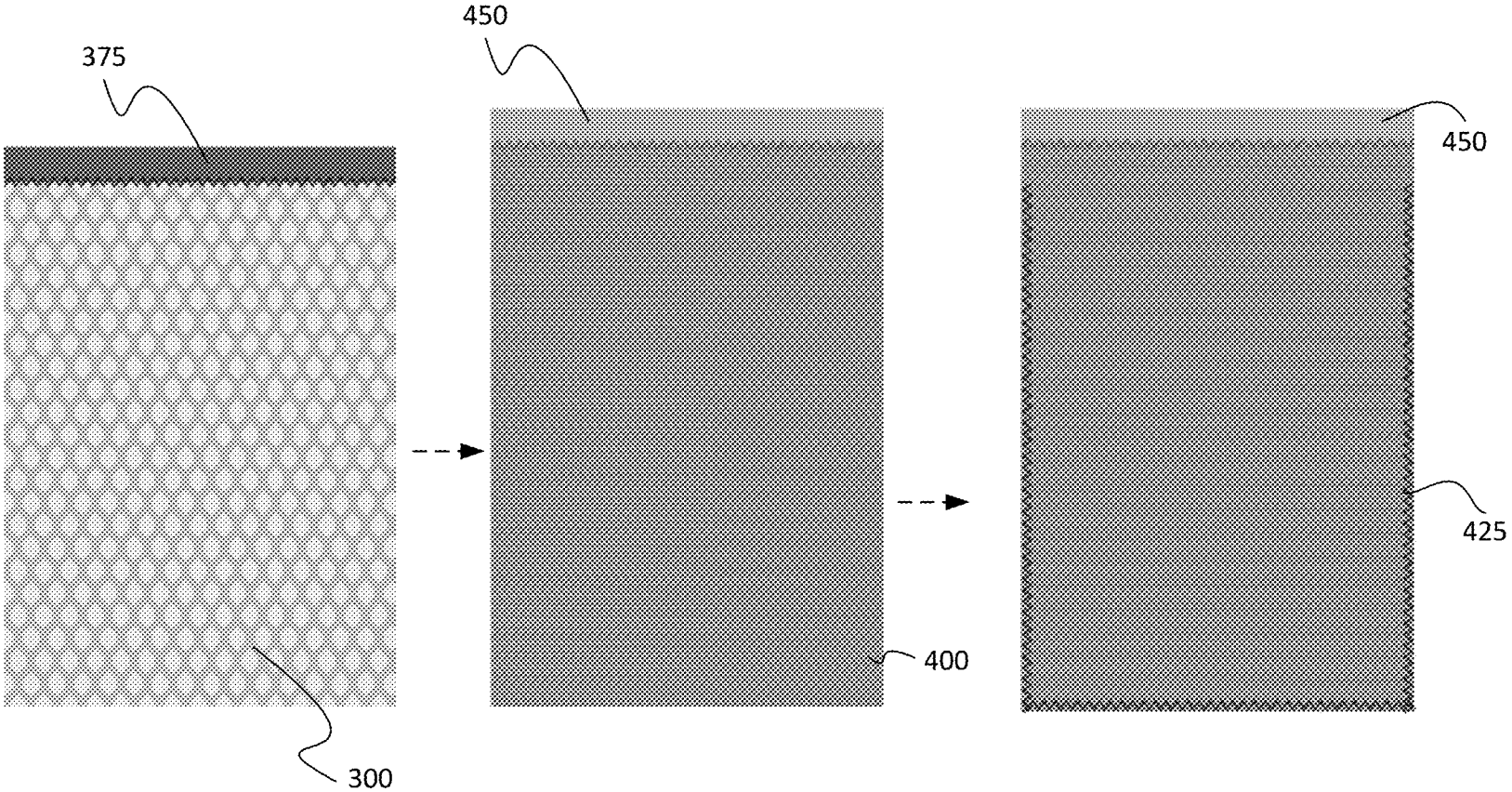
FIGS. 9A, 9B, and 9C depict an exemplary assembly of the storage compartment or pocket in accordance with the present disclosure.
Figure 10:
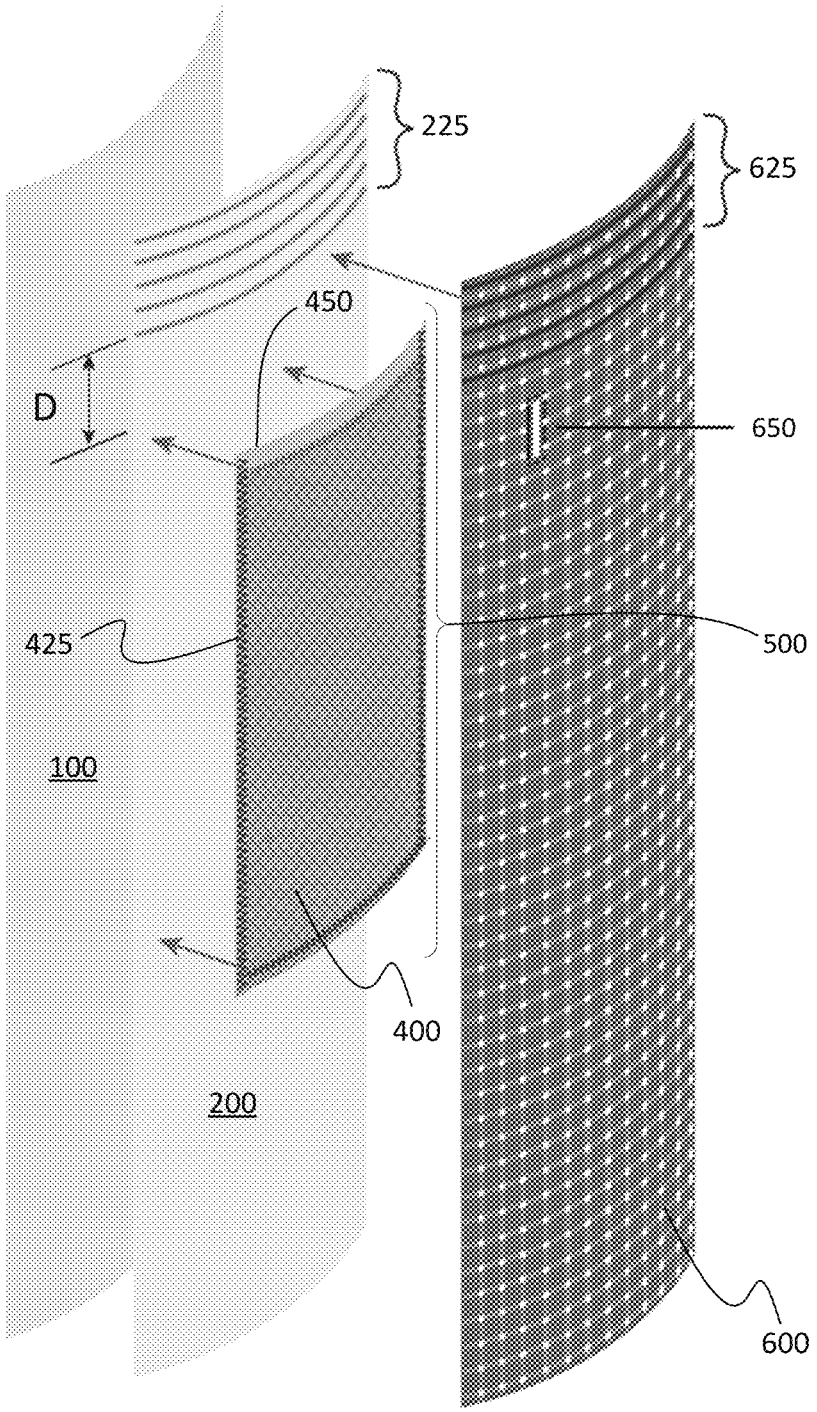
FIG. 10 is an exploded side view of a storage compartment or pocket with optional outer shell fabric for receiving a removable spacer material in accordance with the present disclosure

FIGS. 9A, 9B, and 9C depict an exemplary assembly of the storage compartment or pocket laminate 500 in accordance with the present disclosure, where they suitably sized portion of hydrophobic spacer material 300 is provided and finished top 375 is formed as a portion of the laminate. This portion of the laminate is attached to hydrophobic stretch mesh fabric 400 sized accordingly and provided with finished top 450. These two plies of the laminate can be: (a) fastened together on three sides and then fastened to portion of garment 200 (not shown) so as to form a storage compartment or pocket for receiving an electronic device; or (b) fastened together on three sides while fastening to the portion of garment 200.

As an alternative means of fastening, hydrophobic spacer material 300 and hydrophobic stretch mesh fabric 400 may be adhesively laminated, or ultrasonic or laser welded either together and/or together with the portion of garment 200. Hydrophobic spacer material 300 provides resiliency and moisture repellency and as a soft textile characteristic feel. Hydrophobic stretch mesh fabric 400 provides for close fit and securement of electronic device and in addition provides further reduction from liquids on either the interior or exterior surface thereof. In one aspect, the portion of garment 200 is of a stretchable material similar to or the same as that of hydrophobic stretch mesh fabric 400.

As stated herein, the laminates of the present disclosure can be readily fastened to many different articles. Non-limiting examples include running shorts, tennis shorts, basketball shorts, sleeves, sweatshirts, and other garments.

These articles can include pieces of laminates joined together. In other aspects, a portion of the hydrophobic stretch mesh fabric 400 of the storage compartment or pocket 500 can be configured with a transparent material or film suitable for operably interacting with touchscreens of various electronic devices so long as the size and shape of the transparent material or film does not negatively impact the ability of the storage compartment or pocket 500 from receiving and/or securing the electronic device.

Liquid proofing the stitching about the storage compartment or pocket 500 can further be envisioned. One example is by first sewing the non-removable hydrophobic spacer material 300 and hydrophobic stretch mesh fabric 400 together using conventional sewing techniques. Liquid-proof sealing of these sewn seams can then be accomplished by the application of a seam tape or bonding treatment as is known in the art. The seal seam may have a thermoplastic hot melt adhesive which seals to the surface of the laminate and creates a seal over the stitches for improved comfort and to avoid unraveling of the stitches.

In one example, hydrophobic spacer material 300 is provided as a removable hydrophobic spacer material 307. Thus, removable hydrophobic spacer material 307 is not stitched or threaded at bottom edge 350, but rather, has parallel lateral side edges 376 and parallel lateral top and bottom edges 375 and 377, respectively. In one example, removable hydrophobic spacer material 307 is sown on all four sides. In another example, removable hydrophobic spacer material 307 is sown on all four sides using a turned back hem with cover stitch comprising a non-stretching thread so as to reduce or eliminate exposure of the raw edges of the spacer material.

Thus, with reference to FIGS. 10-12B, a sectional side view of a storage compartment or pocket 500 (without removable spacer material 307) with optional outer shell fabric 600 is shown with edge 625 of outer shell fabric 600 bonded to portion of garment 200 and bottom edge 425 of hydrophobic stretch mesh fabric 400 bonded directly to garment fabric 200 forming a pocket for receiving a removable spacer material 307. Outer shell 600 is shown with opening 650 for charge port or speaker cord.

Figure 11:
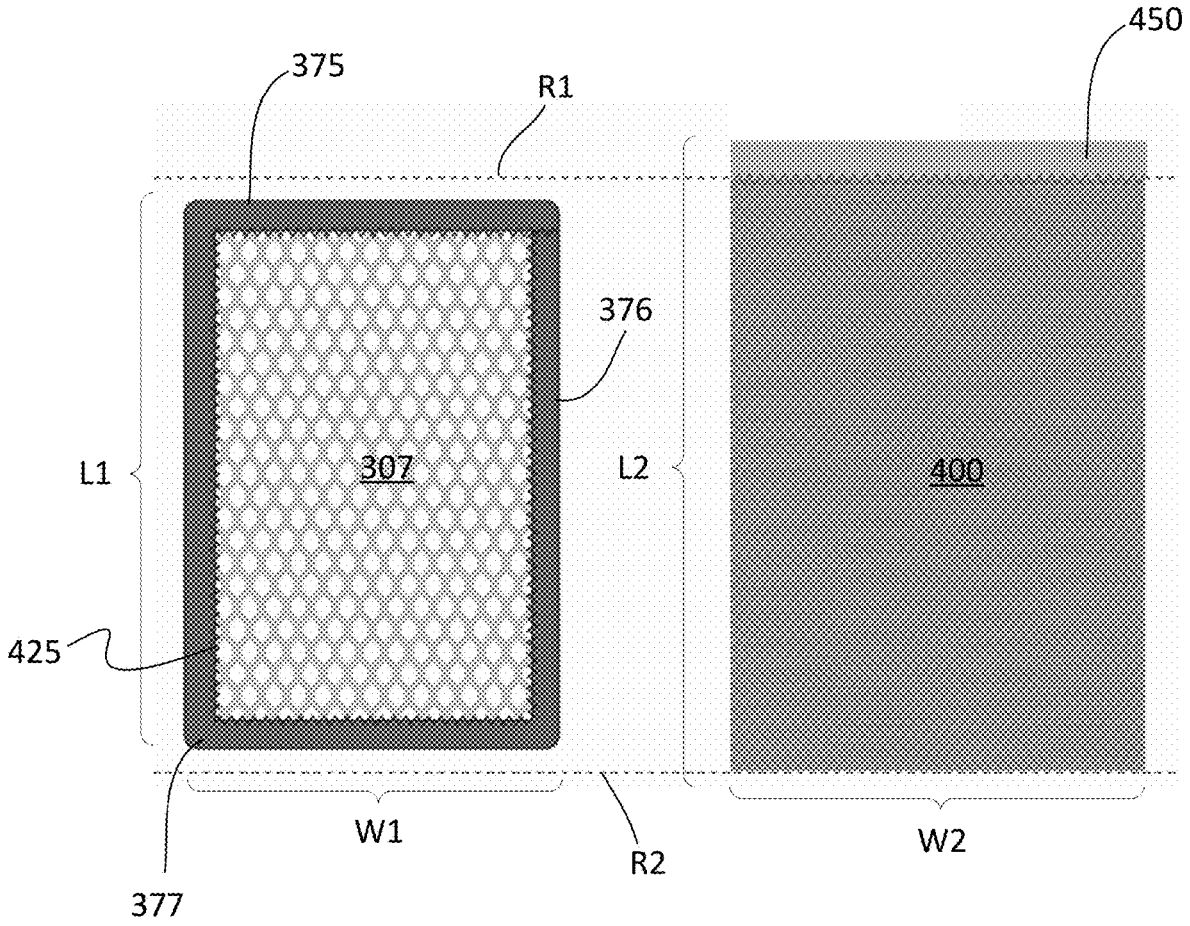
FIG. 11 is a partial exploded view of the removable spacer material and stretch mesh fabric of the storage compartment or pocket in accordance with the present disclosure.

With reference to FIG. 11, removable spacer material 307 shown in a partially exploded view with hydrophobic stretch fabric 400. Removable spacer material 307 has a length (L1) and width (W1) smaller than corresponding length (L2) and width (W2) of hydrophobic stretch fabric 400 as shown by dotted reference lines R1 and R2, such that when the pocket 500 is formed by attachment of hydrophobic stretch fabric 400 to garment 200, the removal spacer material 307 can be removably engaged with the pocket 500. In one example, the removable spacer material 307 is about 80% to 95% of the size of pocket 500. The removable spacer material 307 is designed to be lightweight, having a substantially open structure substantially throughout, and can be configured for one-time use, or machine washable for multiple uses.

In one example, hydrophobic stretch fabric 400 is attached to garment 200 with water resistant or waterproof thread 425. Hydrophobic stretch fabric 400 is sewn or stitched about the two longitudinal sides and one bottom side thereof, so as to form an opening for receiving the removable spacer material 307 and/or the electronic device. In one example, finished top 450 is fabricated with a turned back hem with cover stitch for improved comfort.

Figure 12A:
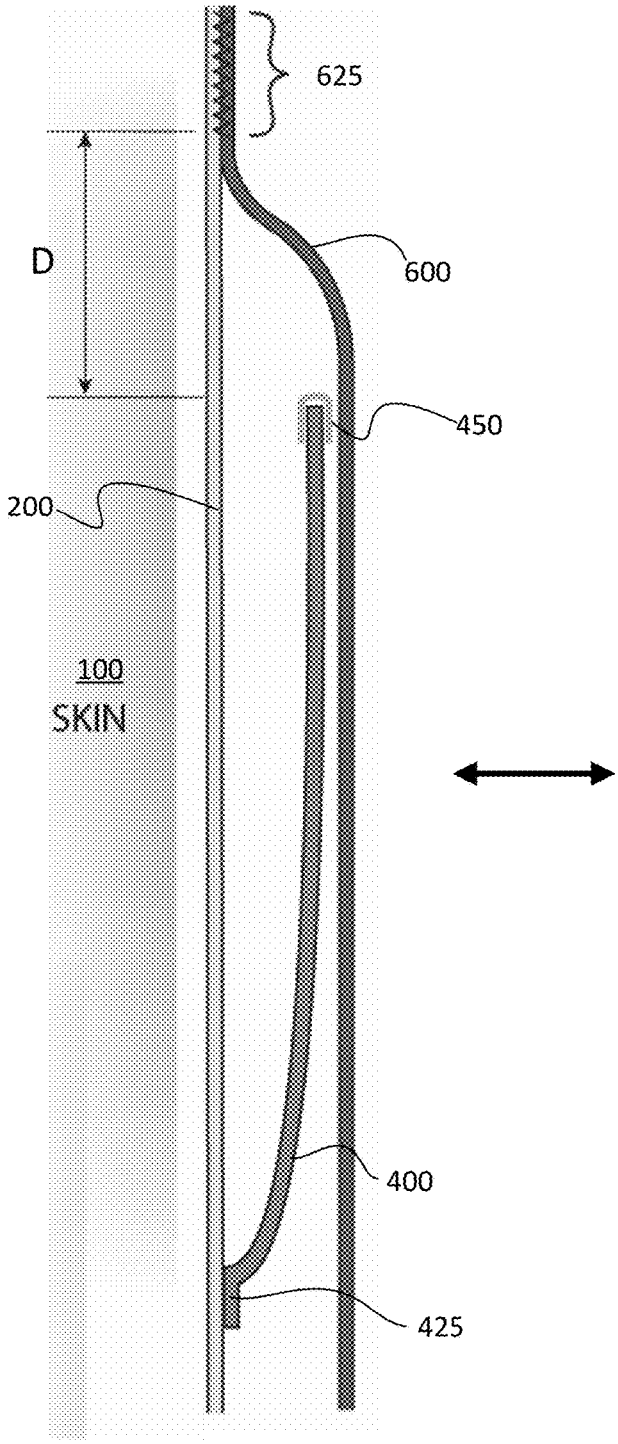
FIG. 12A is a sectional side view of the storage compartment or pocket attached to the garment without the removable spacer material in accordance with the present disclosure.
Figure 12B:
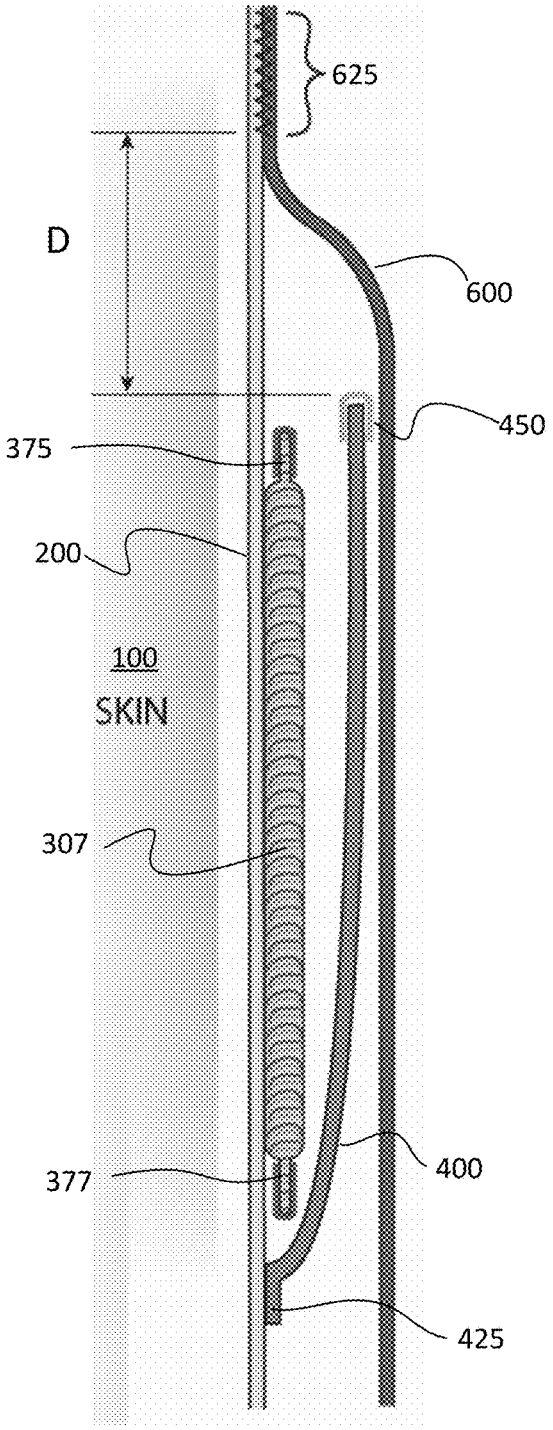
FIG. 12B is a sectional side view of the storage compartment or pocket attached to the garment with the removable spacer material in accordance with the present disclosure.

With reference to FIGS. 12A and 12B, a sectional side view of the storage compartment or pocket 500 attached to the portion of garment 200 with optional outer shell fabric 600 is shown without the removable hydrophobic spacer material 307 and the with removable hydrophobic spacer material 307 positioned in the pocket 500 formed by the hydrophobic stretch mesh fabric 400 bonded to garment 200, respectively. In one example, hydrophobic spacer material 307 comprises skin-facing surface 305 and opposing surface 310 (not shown) of a microporous material and/or contains a honeycomb or other open pattern type design with hydrophobic fiber filaments 320 (not shown) contained there between to permit airflow, as described above. The removable hydrophobic spacer material 307 is configured for positioning between garment fabric 200 and electronic device 75 (not shown). In one example, at least a portion of edges 376 or 375 contain fastening means, such as VELCRO™ or other means to impart friction, or resistance of movement, of the hydrophobic spacer material 307 from the garment fabric 200 when inserted into pocket 500.

Removable hydrophobic spacer material 307 in one example is configured for positioning a distance (D) from the elastomeric banding 625 of garment 200. In one example, D is 1 cm, 2 cm, or 3 cm. By virtue of the fact that hydrophobic stretch mesh fabric 400 is configured to stretch in at least 2 directions, or in at least 4 directions, fabric 400 will provide securement of electronic device 75 in combination with removable hydrophobic spacer material 307. Removable hydrophobic spacer material 307 in one aspect has elasticity less than that of stretch mesh fabric 400. Removable hydrophobic spacer material 307 in one aspect as resiliency of at least 2× that of wool, at least 5× that of wool, or at least 10× that of wool. The resiliency of removable hydrophobic spacer material 307 in combination with hydrophobic stretch mesh fabric 400 provides for containment of the electronic device during wearing of the garment by a user.

Unless otherwise indicated, all numbers expressing quantities, amounts, sizes, and properties such as reaction conditions, and so forth used in the Specification and exemplary claims are to be understood as being modified in all instances by the term "about." Accordingly, unless indicated to the contrary, the numerical parameters set forth in the Specification and Claims are approximations that may vary depending upon the desired properties sought to be determined by the present disclosure.

Notwithstanding that the numerical ranges and parameters setting forth the broad scope of the disclosure are approximations, the numerical values set forth are reported as precisely as possible. Any numerical value, however, inherently contain certain errors necessarily resulting from the standard deviation found in their respective testing measurements.

I claim:

1. A storage compartment or pocket comprising:

a breathable laminate comprising:

hydrophobic stretch fabric secured, at least in part, at three sides to an exterior of a garment so as to form an opening configured to receive an electronic device, the storage compartment or pocket having a length and a width; wherein the garment is a shirt, shorts, pants, or a jacket; and an outer shell material comprising a wicking or non-wicking woven or nonwoven fabric adhered to the garment; and a removable hydrophobic spacer material, having a length and a width sized so as to be received and removed from the storage compartment or the pocket; wherein the removable hydrophobic spacer material has top and bottom surfaces and is sewn or hemmed on all four sides thereof, wherein the hydrophobic spacer is configured to be positioned between the garment and an electronic device wherein the outer shell material reversibly covers the opening.

2. A storage compartment or pocket for an electronic device, comprising:

a garment fabric having a skin facing side and an opposed side;

a removable hydrophobic spacer material adjacent the opposed side; and a hydrophobic stretch fabric adjacent the hydrophobic spacer material, wherein the hydrophobic stretch fabric is secured, at least in part, at three sides to the opposed side of the garment fabric so as to form an opening in the storage compartment or the pocket;

wherein the removable hydrophobic spacer material is 80-95% of the size of the opening so as to be reversibly received and removed from the storage compartment or the pocket;

wherein the removable hydrophobic spacer material having a top surface and a bottom surface sewn or hemmed on all four sides thereof, wherein the hydrophobic spacer is configured to be positioned between the garment and an electronic device.

3. The storage compartment or pocket of claim 2, further comprising an outer shell material comprising a wicking or non-wicking woven or nonwoven fabric.

4. A garment comprising:

a skin facing side;

an opposed side;

a hydrophobic stretch fabric engaged at three sides to the opposed side of the garment defining an opening;

a removable hydrophobic spacer configured to be positioned between the hydrophobic stretch fabric and the garment;

the removable hydrophobic spacer material having a size 80-95% less than the opening so as to be reversibly received and removed from the opening, the removable hydrophobic spacer material being sewn or hemmed on all four sides thereof.

5. The garment of claim 4, further comprising an outer shell material comprising a wicking or non-wicking woven or non-woven material.

* * * * *